United States Patent [19]

Velazquez

[11] Patent Number: 4,834,372

[45] Date of Patent: May 30, 1989

[54] CHANCE DETERMINING DEVICE

[76] Inventor: José Velazquez, Callei K-10, Valparaiso, Baymon, P.R. 00619

[21] Appl. No.: 169,012

[22] Filed: Mar. 16, 1988

[51] Int. Cl.[4] ..... A63F 5/04

[52] U.S. Cl. ..... 273/147; 401/195; 446/259

[58] Field of Search ..... 273/147; 401/195; 446/256, 259

[56] References Cited

U.S. PATENT DOCUMENTS 541,802 6/1895 Barus ..... 446/256 X 1,578,632 3/1926 Sommer ..... 273/147 X 2,573,916 11/1951 Loveday ..... 273/147

*Primary Examiner*—Anton O. Oechsle

*Attorney, Agent, or Firm*—Richard L. Miller

[57] ABSTRACT

A top device is designed for determining chance by spinning it. Primarily, it consists of a body with a lower pointed end and a polygonal shaped upper end that receives a hexagonal pencil that is retained in a tapered hexagonal and vertical opening by friction, and the pencil is employed as a shaft for rotating or spinning the device when employed for chance determining endeavors, while in the alternative the pencil can be removed for writing.

1 Claim, 1 Drawing Sheet

FIG. 1
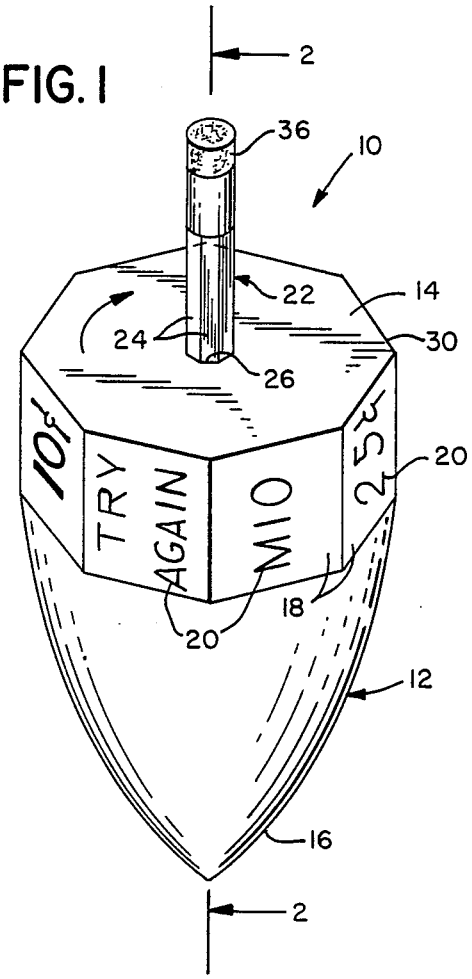
FIG. 2
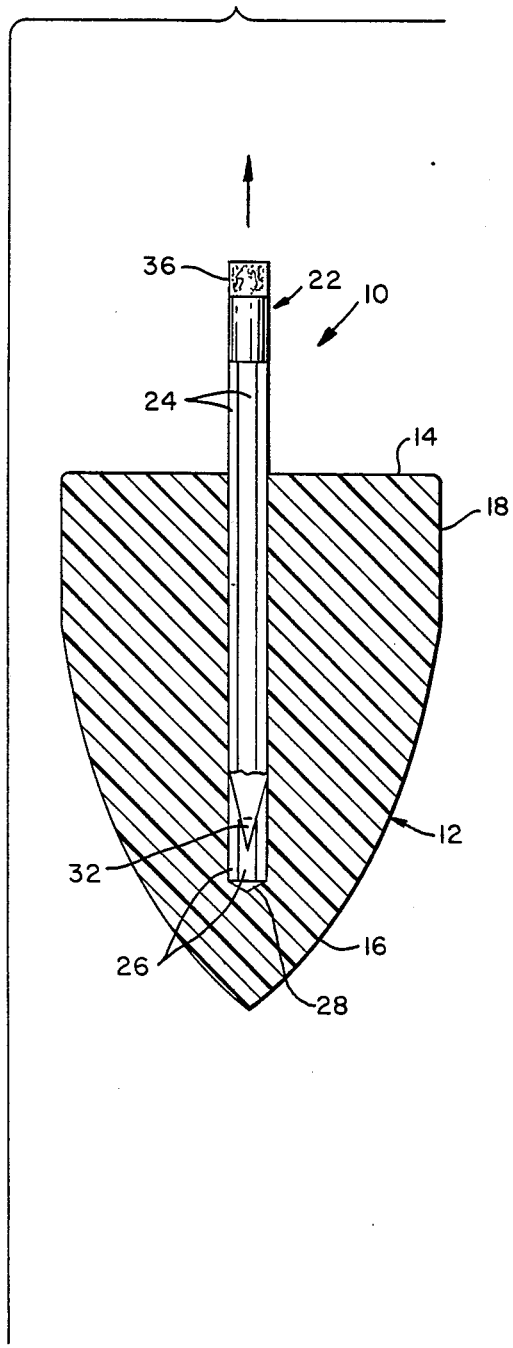
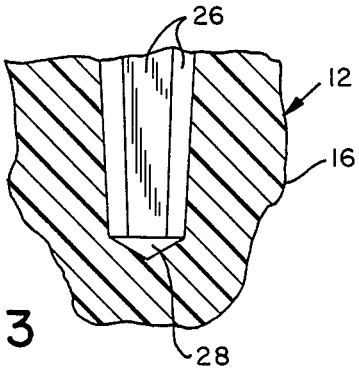
FIG. 3

CHANCE DETERMINING DEVICE

BACKGROUND OF THE INVENTION

The instant invention relates generally to game devices, and more particularly, to a chance determining device.

Numerous game devices have been provided in the prior art that are adapted to be employed as chance determining devices. For example, U.S. Pat. Nos. 2,583,805 of Astle, U.S. Pat. No. 2,023,297 of Vandegrift, and U.S. Pat. No. 1,529,263 of McGinnis all are illustrative of such prior art. While these units may be suitable for the particular purpose to which they address, they would not be as suitable for the purpose of the present invention as hereafter described.

SUMMARY OF THE INVENTION

A primary object of the present invention is to provide a chance determining device that will overcome the shortcomings of the prior art devices.

Another object is to provide a chance determining device that will be unique in design, by employing a self-contained writing instrument for being used to rotate it.

An additional object is to provide a chance determining device that will be of such design, as to be octagonal in shape and being marked on each face thereof for chances.

A further object is to provide a chance determining device that is simple and easy to use.

A still further object is to provide a chance determining device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention;

FIG. 2 is cross sectional view taken along line 2—2 of FIG. 1; and

FIG. 3 is an enlarged fragmentary view, illustrating the taper of the opening.

DETAILED DESCRIPTION OF THE PREFERRED EMBODIMENTS

Turning now descriptively to the drawings, in which like reference characters denote like elements throughout the several views, a device 10 is shown to include a body 12 having an octagonal upper portion 14 and a pointed portion 16 at its lower end, for rotating contact with a smooth surface such as a table or floor. Body 12 may be typically fabricated of plastic, wood, or other suitable material and has flat faces 18 that are inscribed with lettered and numbered characters 20 that denote small amounts of money and other optional phrases of chance.

A pencil 22 is provided for recording any scores played with device 10 and serves as a shaft for being gripped in the fingers of a player to rotate body 12.

It shall be recognized that pencil 22 is hexagonal in cross-sectional configuration, having its faces 24 designed for engagement with similar faces 26 in tapered hexagonal opening 28 through the longitudinal axis of body 12. Pencil 22 is specifically designed to force fit and be non-rotating when in the tapered opening 28, for effective rotation of body 12 as indicated by the arrow 30. Pencil 22 also includes a conventional lead point 32 and an eraser 36.

In use, pencil 22 is gripped in fingers of a player and is rotated, and when released the pointed portion 16 will strike a surface and the body 12 will rotate until vertical sustaining force is lost and the body 12 will fall on a face 18, the uppermost face being the one that is read for chance determining selection.

After a chance has been made the cycle is repeated as many times as is necessary, and when the pencil 22 is needed to write with, the body 12 is held in one hand and the pencil 22 is gripped in the other and pulled from the opening 28.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A chance determining device comprising, a body, face means on said body for engagement with a surface that will hold said body stationary for reading a top face of said face means, and a pencil and shaft combination provided in said body for spinning said body and also for serving as a writing instrument, wherein said face means comprises an polygonal upper portion inscribed with chance indications, and said pencil and shaft combination is removably received in a vertical and central opening provided in said body, wherein said pencil and shaft combination is hexagonal in cross-sectional configuration and side faces of said combination engage with similar internal faces of the opening in said body that is tapered towards a bottom of said body, and when said combination is forced downwards in the opening in said body said combination frictionally engages until forcefully pulled from said body.

* * * * *